United States Patent [19]

Wilder

[11] 4,436,028

[45] Mar. 13, 1984

[54] ROLL MILL FOR REDUCTION OF MOISTURE CONTENT IN WASTE MATERIAL

[76] Inventor: David M. Wilder, 82061 Lost Valley La., Dexter, Oreg. 97431

[21] Appl. No.: 377,262

[22] Filed: May 10, 1982

[51] Int. Cl.[3] ..... B30B 3/04

[52] U.S. Cl. ..... 100/121; 100/75

[58] Field of Search ..... 100/121, 126, 131, 136, 100/170, 176, 118, 173, 70 R, 70 A, 71, 75; 99/457, 464, 495; 68/226

[56] References Cited

U.S. PATENT DOCUMENTS

| | | | |
|---|---|---|---|
| 712,545 | 11/1902 | Just | 99/464 |
| 1,321,956 | 11/1919 | Wagner . | |
| 2,828,081 | 3/1958 | Collins et al. . | |
| 2,987,988 | 6/1961 | Robledano | 100/118 |
| 3,263,598 | 8/1966 | Sylla | 100/71 |
| 3,697,324 | 10/1972 | Steele et al. | 100/121 |
| 3,952,647 | 4/1976 | Holbrook et al. | 100/173 |

OTHER PUBLICATIONS

"Potential For Compression Drying of Green Wood Chip Fuel", vol. 31, #8, Forest Products Journal.

*Primary Examiner*—Harvey C. Hornsby
*Assistant Examiner*—Michael Knick
*Attorney, Agent, or Firm*—James D. Givnan, Jr.

[57] ABSTRACT

A two roll press machine for removing moisture from particulate organic material includes a stationary powered roll and a powered positionable roll journalled within a carriage slidably entrained on a machine base. A hydraulic cylinder biases the movable roll into heavily biased, linear contact with the stationary roll. Barrier plates in place above the rolls laterally confine expelled fluid. Collector boxes proximate the extremes of the roll nip remove the fluid. A spreader mechanism is supported on the machine base for distribution of material across the rolls. The machine base permits stacking of the machines for sequential pressing of material.

6 Claims, 4 Drawing Figures

ROLL MILL FOR REDUCTION OF MOISTURE CONTENT IN WASTE MATERIAL

BACKGROUND OF THE INVENTION

The present invention concerns a press for the reduction of organic material to flake form for use as a fuel as such or in other processed forms.

A by-product of various wood product operations are wood particles of random shape and size including bark, termed hog fuel in the trade. Such material is a low cost source of energy and is often used to fire industrial boilers. A drawback to such use is its high moisture content prohibiting or severely reducing its utility as a boiler fuel. A USDA report dated 1976, "The Feasability of Utilizing Forest Residues for Energy and Chemicals" noted that when moisture content is 50% of wood particle weight, boiler efficiency is only 65%. When particle moisture content reaches 68% of particle weight, the fuel will not maintain a fire in most boilers. In view of this, while wood waste is readily available such is not a popular source of fuel. A reduction in water content would greatly enhance wood waste as a fuel but the amount of energy necessary to accomplish even partial drying, under known systems, is prohibitive. Drying of wood waste particles by the conventional application of direct heat utilizes upwards of 1200 BTU's per pound of water removed. Accordingly, a potentially usable and readily available fuel is largely unused.

A report appearing in the FOREST PRODUCTS JOURNAL, Volume 31, No. 8, entitled "Potential For Compression Drying of Green Wood Chip Fuel", by John G. Haygreen, discusses the problems of reducing moisture in wood bark and chips by use of mechanical pressure and specifically the use of roll presses, among other equipment, for moisture reduction. Problem areas are mentioned which include the drawing off of expelled water prior to termination of pressing forces to prevent re-absorption of the expelled water. Additionally noted was the fact that high nip pressures in the range of 8,000 to 10,000 pounds per lineal inch minimized the capability of the wood chip to thereafter assume its original water-absorbing form.

The use of a "roller mill" is disclosed in U.S. Pat. No. 2,828,081 for the treating of tree bark for the separation of its cork constituent. The mill performs essentially a separation by a shearing action. U.S. Pat. No. 2,987,988 discloses grooved rolls in a roll mill for the expulsion of moisture from fibrous organic material as does U.S. Pat. No. 1,321,956. None of the known prior art is highly adaptable to present purposes.

SUMMARY OF THE PRESENT INVENTION

The present invention is embodied within a press for significantly reducing the moisture content and increasing bulk density of organic fibrous material such as wood and tree bark particles, or other biomass material, by reducing the material to flake form with a moisture content conducive to efficient use as a fuel.

The base material may be of an organic fibrous nature, such as tree bark, wood, leaves or needles if a conifer, or other organic wasted material of a fibrous nature having a moisture content hindering use of same as a fuel. Typically moisture content by weight of organic fibrous material will range in their natural state from 30 percent to 90 percent. The material to be processed in accordance with the present invention is initially subjected to sizing as by subjecting same to a hammer mill subsequent to the removal of foreign or metallic bodies. The material is thereafter sized, as by screening to a longest dimension of ¾ of an inch or so. Moisture reduction is essentially accomplished in a two roll mill whereat the sized material is subjected to severe pressures for moisture removal with the particle taking flake form. The flake may be used as a furel source having a high bulk density or be subjected to still further processes, for example gasification, cubing, pelletizing, etc.

Important objectives include the provision of a roll mill which, on a practical basis, reduces the moisture content of organic fibrous waste to increase its bulk density to enable use of same as a fuel on a practical basis; the provision of a two roll mill which utilizes roll exerted pressure to reshape three dimensional particles to flake form with a reduced moisture content and suitable for use as a fuel in flake form or for further processing into other physical shapes as dictated by storage, shipping and use criteria; the provision of a process wherein moisture reduction is accomplished by roll means subjecting the material to extreme pressures to exert a high per linear inch pressure on the processed particles exceeding 10,000 PSI with provision made for drawing off the extracted moisture; the provision of a press for reducing particle moisture and adapted to thereafter discharge same downwardly from the foll surface to a second like press if necessary.

DETAILED DESCRIPTION OF THE PREFERRED EMBODIMENT

Figure 1:
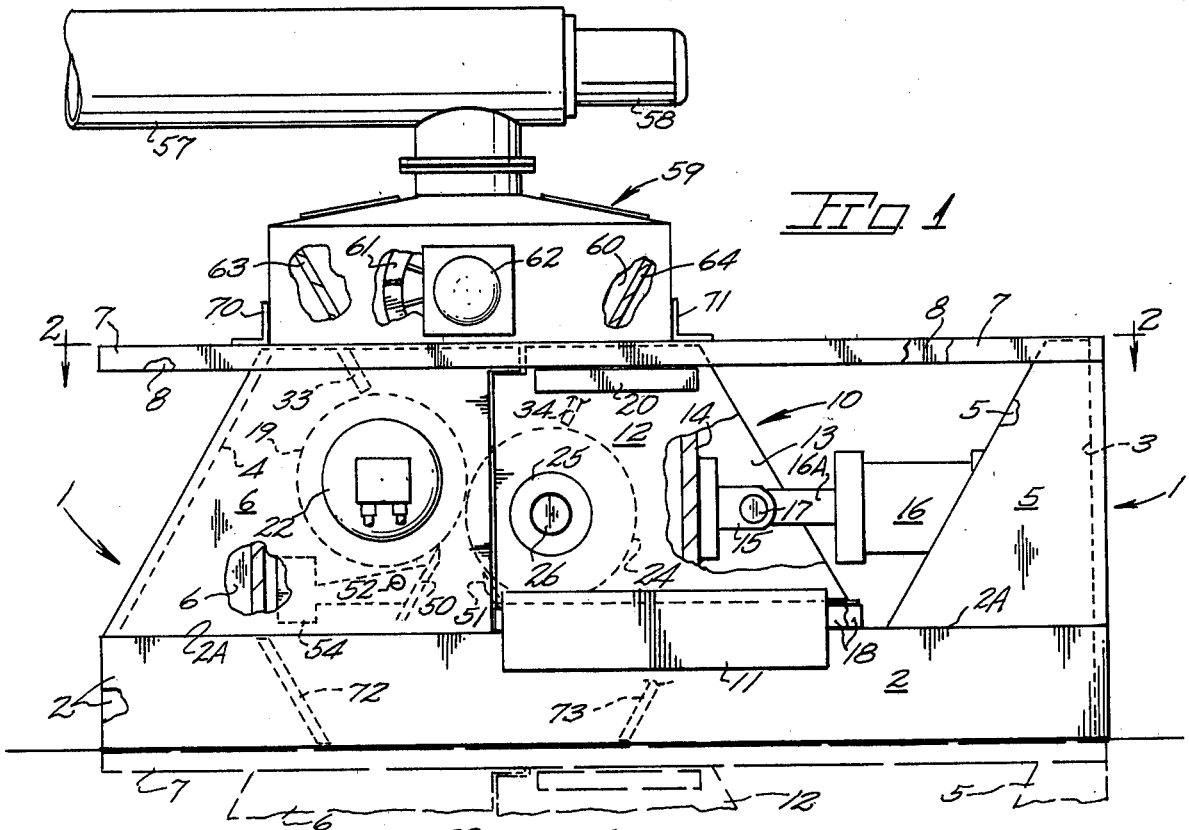
FIG. 1 is a side elevation view of two roll press machine.

With continuing reference to the drawing wherein applied reference numerals indicate parts similarly hereinafter identified, the reference numeral 1 indicates the base of the present machine which includes lengthwise extending box beam members 2. As later described, the machine base is suited for superimposed or stacked modular placement on a like machine or, alternatively, on other supporting structure.

The beams 2 are joined at their ends by end plates 3 and 4 which are integral with pairs of upright side plates 5 and 6 at opposite ends of the base. Said side plates are in welded securement with upper surfaces 2A of the beams and support at their uppermost sides parallel, fixed rail members at 7 and 8 of the base which extend lengthwise of the machine.

A roll carriage indicated generally at 10 is movably mounted on the machine base and is confined for rectilinear movement therealong by retainer members 11 depending from the exterior of carriage side walls at 12 and 13. Extending intermediate said side walls is a pressure plate 14 on which a clevis structure 15 is mounted. A hydraulic cylinder at 16, base mounted on end plate 3, includes a rod 16A secured in said clevis structure by pin means 17. Slide bearings as at 18 support the carriage for cylinder actuated movement along the machine base.

Elevated rails 7 and 8 are rigidly supported on the upper sides of pairs of plate members 5 and 6 and provide stationary bearing surfaces for pairs of slide bearings at 20 mounted on the outer sides of carriage side members 12 and 13. Accordingly, carriage 10 is entrained on the machine base in a constrained manner assuring carriage alignment with the base under later described operating loads.

A first or fixed axis press roll 19 is suitably supported at intermediate paired side plates 6 by plate mounted bearings 21. A roll driving motor at 22 is suitably mounted in place on one of said side plates 6 and is suitably coupled to a roll shaft 23. The motors for driving the first and the later described second roll are of the low speed, high torque type dispensing with the need for gear boxes.

A second or positionable press roll at 24 is suitably journaled within bearings as at 25 carried by the carriage side members 12 and 13. The last mentioned roll is driven by a roll powering hydraulic motor 28 suitably mounted on the adjacent carriage side member and coupled to a roll shaft at 26. From the foregoing it will be seen that movable roll 24 may be shifted by cylinder 16 toward and away from fixed axis roll 19. Cylinder 16 is of a rating capable of applying a force to movable axis roll 24 adequate to provide a per lineal inch pressure at the roll nip N of at least 10,000 pounds.

Figure 2:
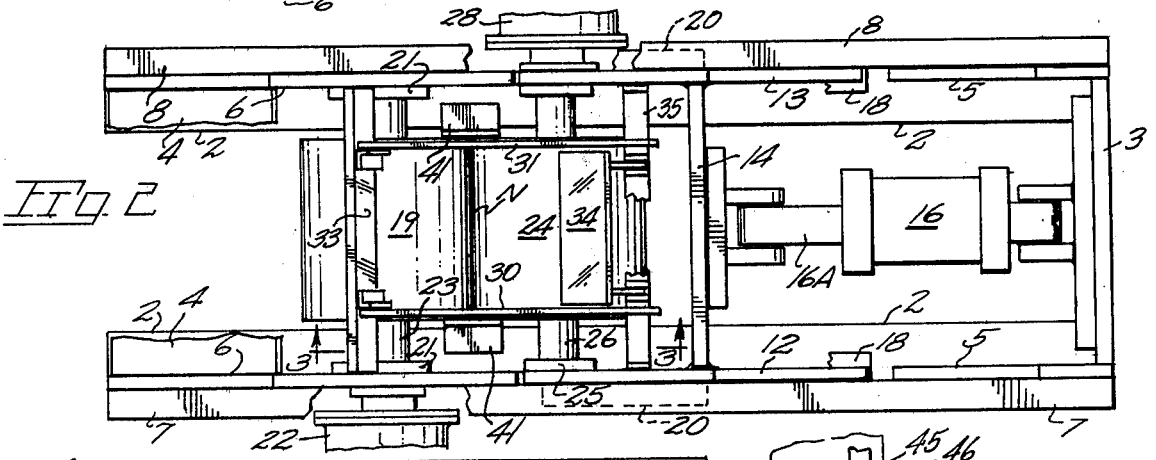
FIG. 2 is a cross-sectional view taken along lines 2—2 of FIG. 1.
Figure 3:
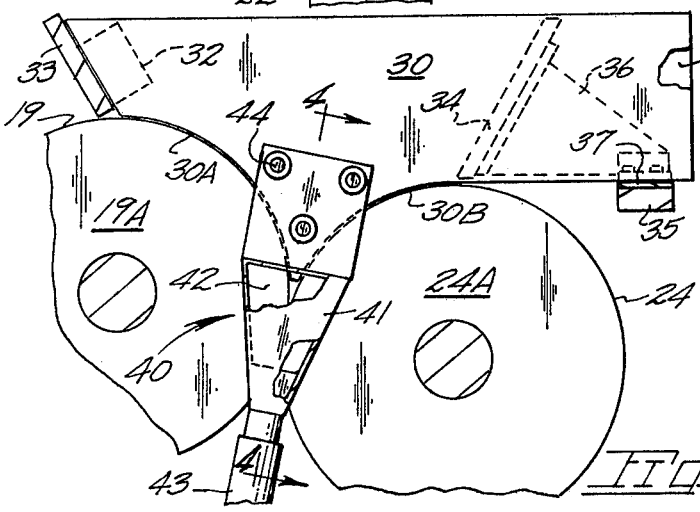
FIG. 3 is a cross-sectional view taken along lines 3—3 of FIG. 2.

With attention to FIGS. 2 and 3, it will be seen that a pair of barriers at 30 and 31 in the form of upright plates are located adjacent the corresponding end of the rolls to confine the sized particulate matter on the roll surfaces as well as to function as dams to laterally confine a pool that forms immediately above the roll nip at N. The barriers have arcuate lower ends at 30A and 30B in FIG. 3 proximate the roll peripheral surfaces.

Extending across each of the rolls are baffles at 33 and 34. Baffle 33 is supported by brackets 32 on the inner sides of side plates 6, while baffle 34 is supported by a crossmember 35 extending from intermediate side walls 12 and 13 of the carriage. Brackets at 36 couple baffle 34 to said crossmember. A bearing surface at 37 slidably supports the distal ends of barriers 30 and 31 as crossmember 35 moves with the carriage while the barriers are stationary.

Figure 4:
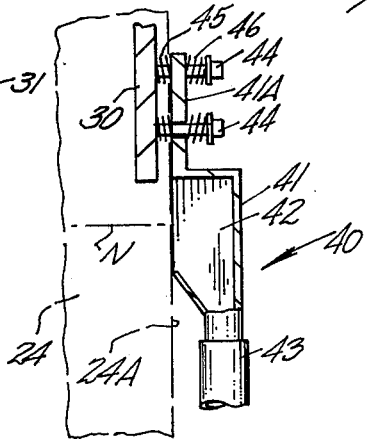
FIG. 4 is a cross-sectional view taken along lines 4—4 of FIG. 3.

With joint attention to FIGS. 3 and 4, conduit discharge means are indicated generally at 40 in place on barrier 30 which is typical of such means carried by remaining barrier 31. A collector box at 41 is open along one side to ride in biased edge contact with the side surfaces of rolls 19 and 24 adjacent the roll nip ends. Accordingly, liquid pressed from the wood and bark or other organic material pools above the nip area and is drawn off into collector box interior 42 and removed via a discharge conduit 43. The collectors may be conveniently mounted on the lower portions of the barriers by means of posts 44 each spring equipped at 45–46 to bias an upward extension 41A of the collector box into lightly biased contact with roll end surfaces at 19A and 24A.

The lower peripheries of the first and second rolls each rotate past a doctor blade at 50 and 51. Said blades are swingably mounted as typically shown at 52 and urged into roll contact by means of weights as at 54.

A screw conveyor at 57 powered by a motor 58 delivers sized particulate to a feed chamber 60 of a spreader mechanism housing indicated generally at 59. The screw conveyed material is discharged downwardly into said chamber wherein a ribbon screw at 61 distributes same uniformly across the faces of the press rolls. A motor at 62 is coupled to the ribbon screw shaft to power same. A pair of baffles at 63 and 64 direct the gravitating material downwardly onto earlier described baffles 33 and 34 which direct same onto the uppermost roll surfaces. The spreader mechanism is secured in place atop base rail members 7 and 8 by means of brackets 70 and 71. Alternatively, base rail members 7 and 8 may serve to support a second two roll press machine to permit the sequential treatment of the biomass particulate such as when suitable moisture reduction is not achieved during one pass through the press rolls. Located intermediate the base members 2 are additional baffles at 72 and 73 which serve to confine the discharged material for delivery to additional conveying or collecting areas.

Hog fuel will often have an initial moisture content by weight of 30% to 90% which moisture content is not substantially reduced during sizing such as by passing through a screen equipped hammer mill. Maximum particle size is preferably reduced to minus $\frac{3}{4}$ of an inch. Pressing of the organic material under the extremely high pressures of the present press reduces same to flake constituency with particle moisture content ranging between 15% to 50% moisture content by weight depending on initial moisture content. The end product being of flake form has a substantially increased surface area and increased bulk density. Further, the cellular structure of the material has been reconfigured.

While I have shown but one embodiment of the invention it will be apparent to those skilled in the art that the invention may be embodied still otherwise without departing from the spirit and scope of the invention.

Having thus described the invention, what is claimed and desired to be secured under a Letters Patent is:

1. A two roll press machine for removing moisture from organic material, said machine comprising in combination, a machine base, a first roll rotatably mounted on said base and coupled to a roll driving motor and rotatable about a fixed axis, a second roll, a carriage slidably mounting said second roll on said machine base enabling travel of said second roll into and out of linear contact with said first roll, retention means confining said carriage for rectilinear travel on said base, powered means carried by said base and acting on said carriage to urge said second roll into and out of linear contact with said first roll, barriers located superjacent the corresponding sides of said rolls, and discharge means including collector boxes located laterally adjacent the nip of the rolls to remove collected fluid expelled from the organic material.

2. The two roll press machine claimed in claim 1 wherein said barriers have arcuate edges corresponding to the roll peripheries.

3. The two roll press machine claimed in claim 2 wherein said barriers additionally have planar edges in tangential relationship with said second roll.

4. The two roll press machine claimed in claim 1 wherein said machine base includes elevated horizontal base members adapted to support the base of a second machine of like construction to enable stacking of two machines for sequential pressing of material.

5. The two roll press machine claimed in claim 1 wherein said machine base includes elevated horizontal base members, a spreader mechanism in place on said base members for the distribution of organic material across the roll surfaces.

6. The two roll press machine claimed in claim 1 wherein one each of said collector boxes depends from one of said barriers, mounting means resiliently biasing each of said collector boxes jointly into engagement with both rolls whereby the roll sides each partially close the collector box.

* * * * *